United States Patent [19]

Preston et al.

[11] 4,077,415

[45] Mar. 7, 1978

[54] PARTICULARLY TO THE MANUFACTURE OF FILTER-TIPPED CIGARETTES

[75] Inventors: Edward George Preston; Clifford Russell Marritt, both of London, England

[73] Assignee: Molins Limited, England

[21] Appl. No.: 611,687

[22] Filed: Sep. 9, 1975

[30] Foreign Application Priority Data

Sep. 17, 1974 United Kingdom ..... 40449/74

[51] Int. Cl.[2] ..... A24C 1/32; A24C 5/48; A24C 5/58

[52] U.S. Cl. ..... 131/76; 131/94; 73/45.3

[58] Field of Search ..... 131/76, 94, 95, 21 R; 73/45.3, 45.1

[56] References Cited

U.S. PATENT DOCUMENTS

| | | | |
|---|---|---|---|
| 3,527,234 | 9/1970 | Hinemann | 131/94 |
| 3,715,056 | 2/1973 | Preston | 73/45.3 |
| 3,793,512 | 2/1974 | Lorenzen | 131/21 R |
| 3,913,381 | 10/1975 | Heitmann | 73/45.1 |

*Primary Examiner*—Stephen C. Pellegrino
*Attorney, Agent, or Firm*—Craig & Antonelli

[57] ABSTRACT

A cigarette filter attachment machine comprises means for joining filter portions to cigarette portions by rolling adhesive-coated paper around adjacent parts of corresponding filter and cigarette portions, a conveyor for conveying the completed assemblies at regular intervals, a stationary pressure chamber adjacent to the conveyor and arranged to communicate successively with ports in the conveyor which are closed by the completed assemblies, a source of pressure connected to the pressure chamber, and a detector for monitoring the pressure in the chamber to detect the absence of any assembly.

12 Claims, 3 Drawing Figures

PARTICULARLY TO THE MANUFACTURE OF FILTER-TIPPED CIGARETTES

Filter-tipped cigarettes are commonly made by joining double-length filter portions between axially spaced cigarette portions by means of a adhesive-coated piece of paper (commonly known as a "cork patch") which is rolled around the filter portion and overlaps the ends of the cigarette portions. The assemblies thus formed are subsequently cut through the middle to form individual filter-tipped cigarettes.

Filter attachment machines commonly act by rolling the cork patches around the rod assemblies (i.e. each consisting of two cigarette portions and a double-length filter portion) by means of a stationary rolling plate mounted adjacent to a drum onto which the assemblies and cork patches are fed. Occasionally the completed assemblies fail to pass properly through the rolling area and cause a jam or another adverse condition by which the assemblies become joined to one another by the cork patches. It is then necessary to remove the jam or other adverse condition quickly in order to prevent damage to the machine and/or waste of material. It is usually left to an operator to observe the machine and to switch it off or take other corrective action when he sees a jam occurring. The present invention is concerned mainly with means for automatically detecting the occurrence of a jam or other such adverse condition and for taking corrective action.

In this content the term "filter" is intended to include any cigarette mouthpiece.

According to one aspect of this invention, a filter attachment machine for use in the manufacture of filter-tipped cigarettes comprises means for joining filter portions to cigarette portions by rolling adhesive-coated paper around adjacent parts of corresponding filter and cigarette portions, a conveyor for conveying the completed assemblies at regular intervals, a stationary pressure chamber adjacent to the conveyor and arranged to communicate successively with ports in the conveyor which are closed by the completed assemblies, a source of positive or negative pressure connected to the pressure chamber, and a detector for monitoring the pressure in the chamber to detect the absence of any assembly.

Corrective action responsive to a signal from the detector may consist of stopping the delivery of cork patches and/or filter sections to the rolling drum.

The pressure chamber preferably spans two or more ports so as to provide an averaged signal. By this means the detection system can be arranged to ignore a slight leak through one of the ports caused by an assembly which either does not close the port as well as it should, or is bouncing slightly at the moment of testing so as to allow some leakage.

The system may include control circuitry whereby the entire machine is stopped in the event that fault signals continue after a predetermined time interval, for example 10 seconds.

An example of a machine according to this invention is shown in the accompanying drawings. In these drawings.

Figure 1:
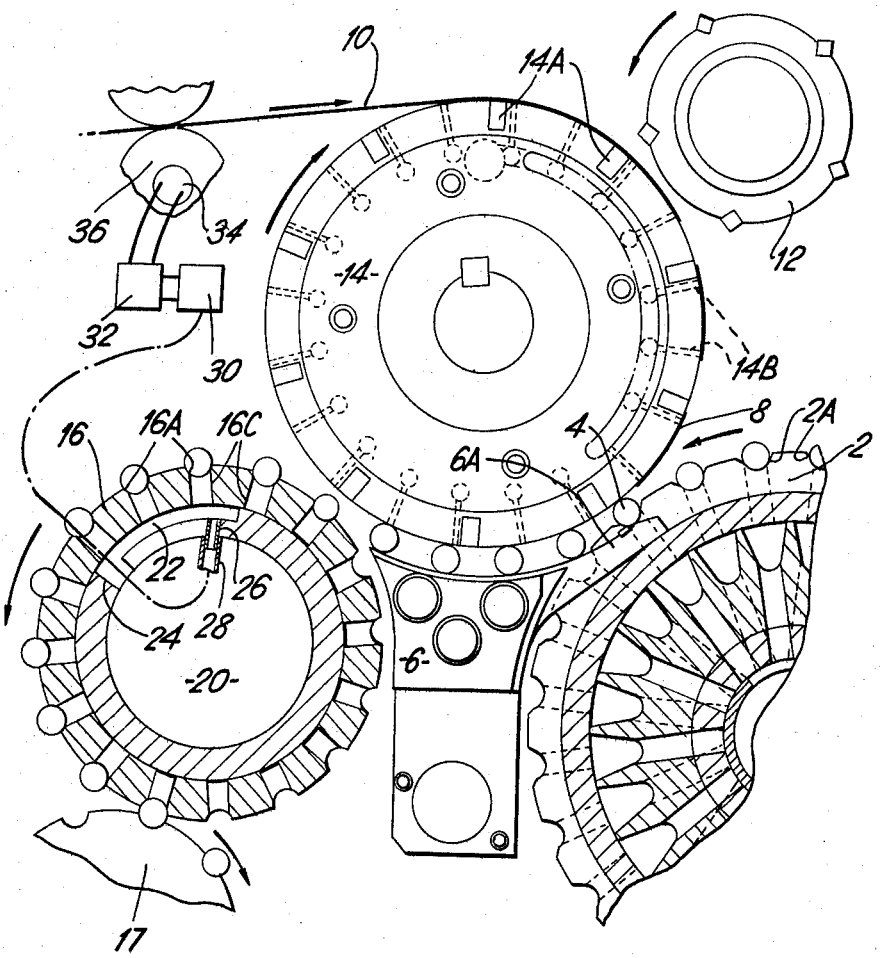
FIG. 1 is a partly sectioned side elevation of part of a filter attachment machine.

The machine shown in FIG. 1 includes a fluted conveyor drum 2 which conveys rod assemblies 4 each comprising two axially spaced cigarette portions abutting against opposite ends of a double-length filter portion. Only one assembly 4 is shown on the drum 2, but it will be understood that all the flutes 2A of the drum 2 carry such assemblies.

The rod assemblies 4 are stripped from the flutes of the drum 2 by fingers 6A on a rolling plate 6. At the same time cork patches 8 are applied to the assemblies, the cork patches 8 being severed from a continuous gummed web of cork material 10 by a cutting drum 12 which cooperates with anvil members 14A set in the periphery of a rolling drum 14; the individual cork patches are carried at regular intervals on the periphery of the rolling drum 14 and towards rolling area by means of suction ports 14B.

Thus the cork patches 8 meet successive rod assemblies 4 at a rolling zone between the drum 14 and the rolling plate 6, and are rolled around the assemblies to form double-length filter tipped cigarettes. These double-length cigarettes are then received in the flutes 16A of a receiver drum 16. A further conveyor drum 17 then receives the double cigarettes from the drum 16, and a circular disc knife cuts the double cigarettes through the middle to form two streams of individual filter-tipped cigarettes.

Figure 2:
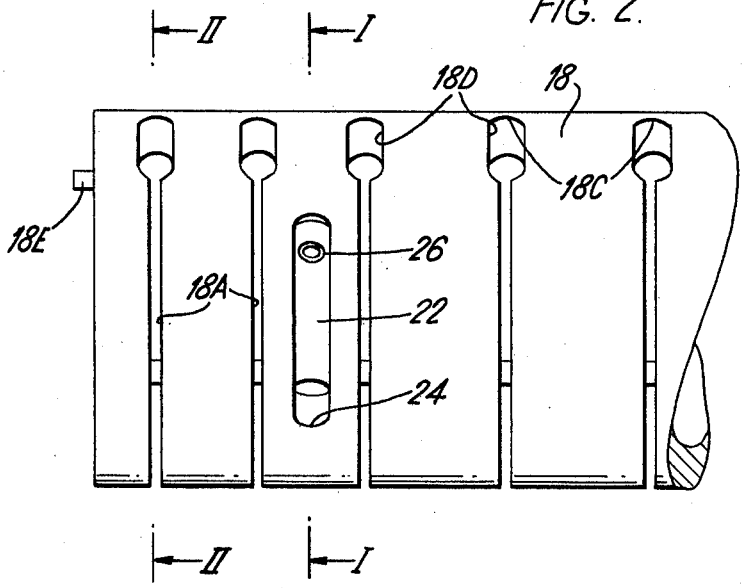
FIG. 2 is a plan view of the sleeve valve for the receiver drum in FIG. 1.

The receiver drum 16 includes a sleeve valve 18 part of which is shown in plan view in FIG. 2. Suction is supplied to a space 20 within the sleeve valve 18, and the purpose of the sleeve valve is to admit suction, where needed, to rows of ports 16B opening into the flutes 16A of the drum 16. For this purpose the sleeve valve is formed with a number of slots 18A through which suction is transmitted to each port 16B from the moment when the corresponding flute 16A receives a double cigarette to the moment when the double cigarette is in turn received by the next conveyor drum 17.

Figure 3:
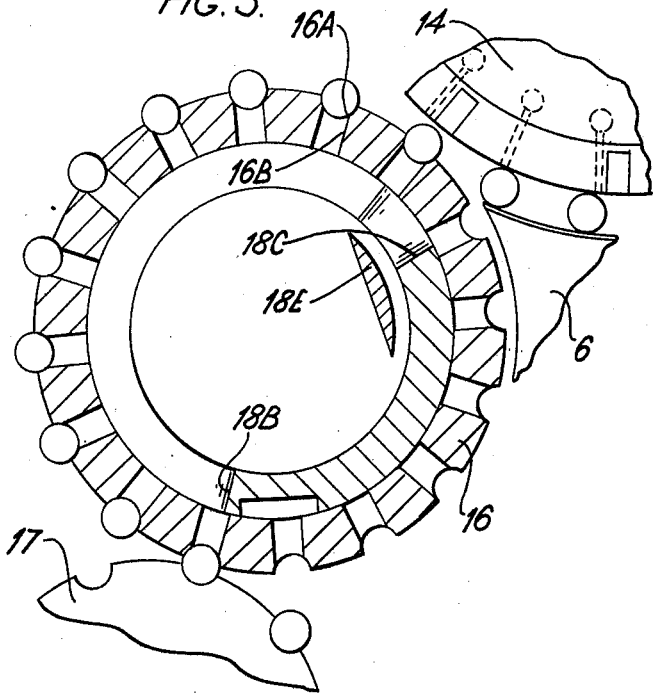
FIG. 3 shows part of FIG. 1 sectioned in a different plane.

FIG. 3 is a section on the line III—III in FIG. 2 and shows that each slot 18A extends for approximately 120°, terminating at positions 18B and 18C. At the end 18C of each slot there is a wider opening 18D so that full suction pressure from the space 20 is applied to pull the cigarette assemblies into the flutes at the transfer point adjacent to the drum 14. Once the cigarettes are in the flutes, less suction is needed, and the relatively narrow main parts of the slots 18A act to throttle down the suction applied to the ports 16B.

A projection 18E on the sleeve valve engages a stationary casing (not shown) to hold the sleeve valve stationary while the drum 16 rotates around it.

FIG. 1 shows the drum 16 and sleeve valve 18 in a section taken on the line I—I in FIG. 2. It shows a chamber 22 which comprises a groove extending for a short distance around the periphery of the sleeve valve. There is a separate set of ports 16C which open out into the flutes 16A (i.e. one for each flute) and are aligned with the chamber 22 so as to communicate with the chamber 22 for a short time. Suction is transmitted to the chamber 22 from the space 20 through an aperture 24. Furthermore, a pipe 26 is set in the sleeve valve so as to communicate with the chamber 22 near the end opposite to the aperture 24; this pipe serves as a pressure tapping, the pressure in the chamber 22 being transmitted through the pipe 26 and via a flexible tube 28 to a transducer 30 which is shown diagrammatically in FIG. 1.

As long as the machine is operating correctly, so that the ports communicating with the chamber 22 are substantially sealed by double cigarettes, the suction pressure felt by the transducer 30 is substantially equal to the suction pressure in the space 20 inside the sleeve valve. However, as soon as cigarettes stop being received by the drum 16, for example as a result of a jam in the rolling area, the suction pressure in the chamber 22 drops since it is leaked away to atmosphere through the corresponding ports, and this fall in pressure is detected by the transducer 30, which transmits a fault signal to a logic circuit 32. This logic circuit then immediately stops a motor 34 which powers a cork drive roller 36, thus stopping the delivery of the cork web to the drum 14; in addition the logic circuit 32 may be arranged to stop the delivery of filter plugs to the drum 2. This will usually enable the jam to clear itself, and if that happens then the logic circuit 32 automatically restarts the motor 34 (and also the plug feed if that was stopped) to resume normal operation. If the fault signal continues for a predetermined time period, for example 10 seconds, the logic circuit 32 may be arranged to switch off the entire machine so that the jam or any other fault condition can be cleared manually by the operator.

Preferably the rolling drum 14 has axially extending serrations over at least part of its peripheral axes to assist in driving forward the assemblies during rolling. Such serrations also help to clear a jam once the cork feed is stopped as described above.

In order to be "fail safe", the transducer may include a switching device which is normally open (i.e. so as not to pass an electric current), being closed only as long as sufficient suction pressure is transmitted to it.

The resumption of the cork feed (and the plug feed if appropriate) may be arranged by the logic circuit to take place a predetermined interval of time, for example 1 second, after the end of the fault signals from the transducer.

It should be noted that the chamber 22 is located as near as possible to the point at which the double cigarettes are received by the drum 16 so as to give the earliest possible warning of a jam in the rolling area.

Furthermore it should be noted that the chamber 22 extends for a significant distance around the sleeve valve so as to communicate continuously with more than one port in the drum 16. This provides an averaging or integrating effect so that the system is not excessively sensitive to a slight leak caused by a mis-shapen filter (in the case of the chamber 22 being aligned with the filters) or by an assembly which is temporarily bouncing slightly in the corresponding flute 16A. The chamber 22 may be extended further around the sleeve valve so as to communicate continuously with more ports in the drum 16, for example four or five.

The missing rod detector according to this invention has wider application. For example, it could be used to detect the occurrence of a missing rod or other article on a conveyor in an entirely different machine. However, one particular additional use is in detecting the existence of a missing filter in a filter attachment machine; for example, the conveyor drum 2 or the drum upstream of it may include a sleeve valve embodying the detection feature of this invention in order to signal, for later ejection, any assembly which is minus its filter.

We claim:

1. A filter attachment machine for use in the manufacture of filter-tipped cigarettes, comprising means for joining filter portions to cigarette portions by rolling adhesive-coated paper around adjacent parts of corresponding filter and cigarette portions, conveyor means including a conveyor having a plurality of ports therein for conveying the completed assemblies at regular intervals, a stationary pressure chamber positioned adjacent to the conveyor to communicate successively with said ports in the conveyor which are closed by the completed assemblies, a source of pressure connected to the pressure chamber, and detector means for monitoring the pressure in the chamber to detect a change in pressure indicative of the absence of any assembly in at least one of the ports communicating with said chamber.

2. A machine according to claim 1 in which the conveyor comprises a fluted drum which carries the completed assemblies by means of suction and includes within the fluted drum a sleeve valve through which suction from within the drum is transmitted to ports opening out in the flutes thereof, the pressure chamber comprising a recess in the outer surface of the sleeve valve which communicates with ports which are axially spaced from additional ports in the flutes through which suction is applied to hold the assemblies on the fluted drum.

3. A machine according to claim 2 in which the pressure chamber is supplied with suction pressure via an aperture in the sleeve valve.

4. A machine according to claim 1 in which the pressure chamber communicates with more than one port in said conveyor at a time, so that the pressure in said chamber is not excessively affected by a slight leak through one port as a result of that port not being completely closed by the associated assembly.

5. A machine according to claim 4 in which the pressure chamber is elongated and in which pressure is supplied to it at or near one end while said detector means is connected to the pressure chamber at or near the other end.

6. A machine according to claim 1 including logic circuit means for stopping the delivery of the adhesive-coated paper and/or of the filter portions in response to a signal from said detector means indicating the absence of complete filter and cigarette assemblies.

7. A machine according to claim 6 in which said logic circuit means includes means for resuming the delivery of paper and/or filter portions as the case may be, in the event of a resumption, within a predetermined time, of the delivery of completed assemblies as indicated by said detector means, and for stopping the machine if the delivery of complete assemblies does not resume by the end of that predetermined time.

8. In a filter cigarette making machine including a fluted conveyor drum which is arranged to carry in its flutes one or more elements of the finished filter cigarettes, the improvement essentially consisting of detector means for detecting the presence and absence of said elements on the fluted drum, said detector means comprising a stationary pressure chamber which is mounted adjacent to the drum to communicate successively with ports formed in the flutes of the drum which are normally closed by the elements contained in the flutes, the port of at least one flute at a time being in communication with said pressure chamber, a source of pressure communicating with said pressure chamber, and pressure detector means for monitoring the pressure in said pressure chamber to detect the absence of a rod on the drum.

9. A machine according to claim 8 wherein said source of pressure comprises a sleeve valve defining a suction space positioned within said drum and a suction source communicating with said suction space by which suction is transmitted to additional ports in the flutes of said drum whereby said elements are suctionally held on said drum, said pressure chamber comprising a recess in the outer surface of the sleeve valve which communicates with said suction space.

10. A machine according to claim 9 wherein said recess in said sleeve valve is elongated and communicates with the suction space via a port in the sleeve valve adjacent to one end of recess, said pressure detector means communicating with the other end of said recess.

11. A filter attachment machine for use in the manufacture of filter-tipped cigarettes, comprising means for joining filter portions to cigarette portions by rolling adhesive-coated paper around adjacent parts of corresponding filter and cigarette portions at a rolling station to form composite assemblies, a conveyor for conveying the composite assemblies at regular intervals, detector means for indicating when composite assemblies cease to be delivered from the rolling station, and logic circuit means for temporarily stopping the delivery of the adhesive-coated paper and/or of the filter portion in response to a signal from said detector means indicating that composite assemblies have ceased to be delivered from the rolling station without stopping operation of the filter joining means, said logic circuit means including means for resuming the delivery of paper and/or filter portions, as the case may be, in the event of a resumption, within a predetermined time, of the delivery of composite assemblies from the rolling station.

12. A filter attachment machine according to claim 11 in which said logic circuit means includes means for stopping the machine if the delivery of composite assemblies from the rolling station does not resume following the resumption of delivery of paper and/or filter portions.

* * * * *